US005797218A

United States Patent [19]

Holland

[11] Patent Number: 5,797,218

[45] Date of Patent: Aug. 25, 1998

[54] ADJUSTABLE AND REMOVABLE SAFETY GATE

[76] Inventor: Matthew W. Holland, 605 S. 25th Street, Colorado Springs, Colo. 80904

[21] Appl. No.: 792,942

[22] Filed: Jan. 21, 1997

[51] Int. Cl.[6] ..... E06B 3/68

[52] U.S. Cl. ..... 49/55; 49/57

[58] Field of Search ..... 49/55, 50, 57, 49/463; 160/372, 381, 377, 388

[56] References Cited

U.S. PATENT DOCUMENTS

| | | | |
|---|---|---|---|
| 4,583,715 | 4/1986 | Wright | 49/55 X |
| 4,611,431 | 9/1986 | Lauro | 49/57 X |
| 4,677,791 | 7/1987 | Larson et al. | 49/55 X |
| 4,685,247 | 8/1987 | Alam | 49/55 |
| 4,702,036 | 10/1987 | Johnson | 49/55 |
| 5,134,806 | 8/1992 | Burkart | 49/55 X |
| 5,442,881 | 8/1995 | Asbach et al. | 49/55 X |
| 5,657,809 | 8/1997 | Longoria et al. | 160/377 X |

*Primary Examiner*—Jerry Redman

[57] ABSTRACT

An adjustable and removable safety gate including a wall mount frame having a pair of door jamb mounts secured to opposing door jambs of a door opening. The wall mount frame includes a telescoping bottom tube. The bottom tube includes a right portion and a left portion whereby the left portion is adjustably received within the right portion. The bottom tube extends between the pair of door jamb mounts. A gate portion is slidably and pivotally coupled with one of the door jamb mounts of the wall mount frame.

10 Claims, 3 Drawing Sheets

ADJUSTABLE AND REMOVABLE SAFETY GATE

BACKGROUND OF THE INVENTION

1. Field of the Invention

The present invention relates to an adjustable and removable safety gate and more particularly pertains to preventing children and pets from entering off-limits areas with an adjustable and removable safety gate.

2. Description of the Prior Art

The use of safety gates is known in the prior art. More specifically, safety gates heretofore devised and utilized for the purpose of impeding passage are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,117,585 to Andrisin, III discloses a locking apparatus for use in adjusting the width of a closure.

U.S. Pat. No. 5,396,732 to Anderson discloses a safety barrier.

U.S. Pat. No. Des. 355,261 to Abrams et al. discloses the ornamental design for a child security gate.

U.S. Pat. No. 4,677,791 to Larson et al. discloses an adjustable gate for doorways.

U.S. Pat. No. 4,583,715 to Wright discloses a safety gate.

While these devices fulfill their respective, particular objective and requirements, the aforementioned patents do not describe an adjustable and removable safety gate for preventing children and pets from entering off-limits areas.

In this respect, the adjustable and removable safety gate according to the present invention substantially departs from the conventional concepts and designs of the prior art, and in doing so provides an apparatus primarily developed for the purpose of preventing children and pets from entering off-limits areas.

Therefore, it can be appreciated that there exists a continuing need for new and improved adjustable and removable safety gate which can be used for preventing children and pets from entering off-limits areas. In this regard, the present invention substantially fulfills this need.

SUMMARY OF THE INVENTION

In the view of the foregoing disadvantages inherent in the known types of safety gates now present in the prior art, the present invention provides an improved adjustable and removable safety gate. As such, the general purpose of the present invention, which will be described subsequently in greater detail, is to provide a new and improved adjustable and removable safety gate and method which has all the advantages of the prior art and none of the disadvantages.

To attain this, the present invention essentially comprises a wall mount frame having a pair of door jamb mounts. The door jamb mounts are secured to opposing door jambs of a door opening. Each of the door jamb mounts are comprised of a circular disk having a mounting aperture therethrough. A semi-circular receiving sleeve is integral with an outer surface of the circular disk. The wall mount frame includes a left mount and a right mount. The left mount comprises an elongated cylindrical member. The left mount has an interior surface and an exterior surface. The interior surface has a mounting knob extending outwardly of an upper end thereof. The mounting knob is removably received within one of the receiving sleeves of the door jamb mount on a left side of the door jamb. The interior surface has a rubber stop secured on a lower end thereof. The exterior surface has a pair of sleeves disposed thereon. An aperture extends through a lower end of the exterior surface. The right mount comprises an elongated cylindrical member. The right mount has an interior surface and an exterior surface. The interior surface of the right mount has a mounting knob extending outwardly of an upper end thereof. The mounting knob is removably received within one of the receiving sleeves of the door jamb mount on a right side of the door jamb. The interior surface of the right mount has a rubber stop secured on a lower end thereof. An upper end of the right jamb has a receiving recess extending downwardly thereof. The upper end has a strap secured thereto disposed on one side of the receiving recess. The strap has a female coupler on a free end thereof. A male coupler is disposed on an opposing side of the receiving recess from the strap. An oval-shaped recess extends through a lower end of the exterior surface of the right jamb. The wall mount frame includes a telescoping bottom tube. The bottom tube includes a right portion and a left portion whereby the left portion is adjustably received within the right portion. A free end of the left tube is removably received within the aperture of the exterior surface of the left mount. A free end of the right portion has an oval-shaped knob disposed thereon. The oval-shaped knob is removably received within the oval-shaped recess of the right jamb. The right portion has a recess formed therein inwardly of the free end thereof. The device includes a gate portion having a generally rectangular configuration. The gate portion has a left side member, a right side member, an upper telescoping member, a lower telescoping member and four L-shaped corner brackets together forming the gate portion. The left side member has a pair of inverted L-shaped brackets disposed on an interior surface thereof. The brackets are slidably and pivotally received within the pair of sleeves of the left mount of the wall mount frame. An upper right corner bracket has an extension extending outwardly thereof. The extension is removably received within the receiving recess of the right mount of the wall mount frame. A lower right corner bracket has a lower extension extending downwardly therefrom. The lower extension is removably received within the recess formed in the right portion of the bottom tube of the wall mount frame.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved adjustable and removable safety gate which has all the advantages of the prior art safety gates and none of the disadvantages.

It is another object of the present invention to provide a new and improved adjustable and removable safety gate which may be easily and efficiently manufactured and marketed.

It is a further object of the present invention to provide a new and improved adjustable and removable safety gate which is of durable and reliable construction.

An even further object of the present invention is to provide a new and improved adjustable and removable safety gate which is susceptible of a low cost of manufacture with regard to both materials and labor, and which accordingly is then susceptible of low prices of sale to the consuming public, thereby making such an adjustable and removable safety gate economically available to the buying public.

Even still another object of the present invention is to provide a new and improved adjustable and removable safety gate for preventing children and pets from entering off-limits areas.

Lastly, it is an object of the present invention to provide a new and improved adjustable and removable safety gate including a wall mount frame having a pair of door jamb mounts secured to opposing door jambs of a door opening. The wall mount frame includes a telescoping bottom tube. The bottom tube includes a right portion and a left portion whereby the left portion is adjustably received within the right portion. The bottom tube extends between the pair of door jamb mounts. A gate portion is slidably and pivotally coupled with one of the door jamb mounts of the wall mount frame.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
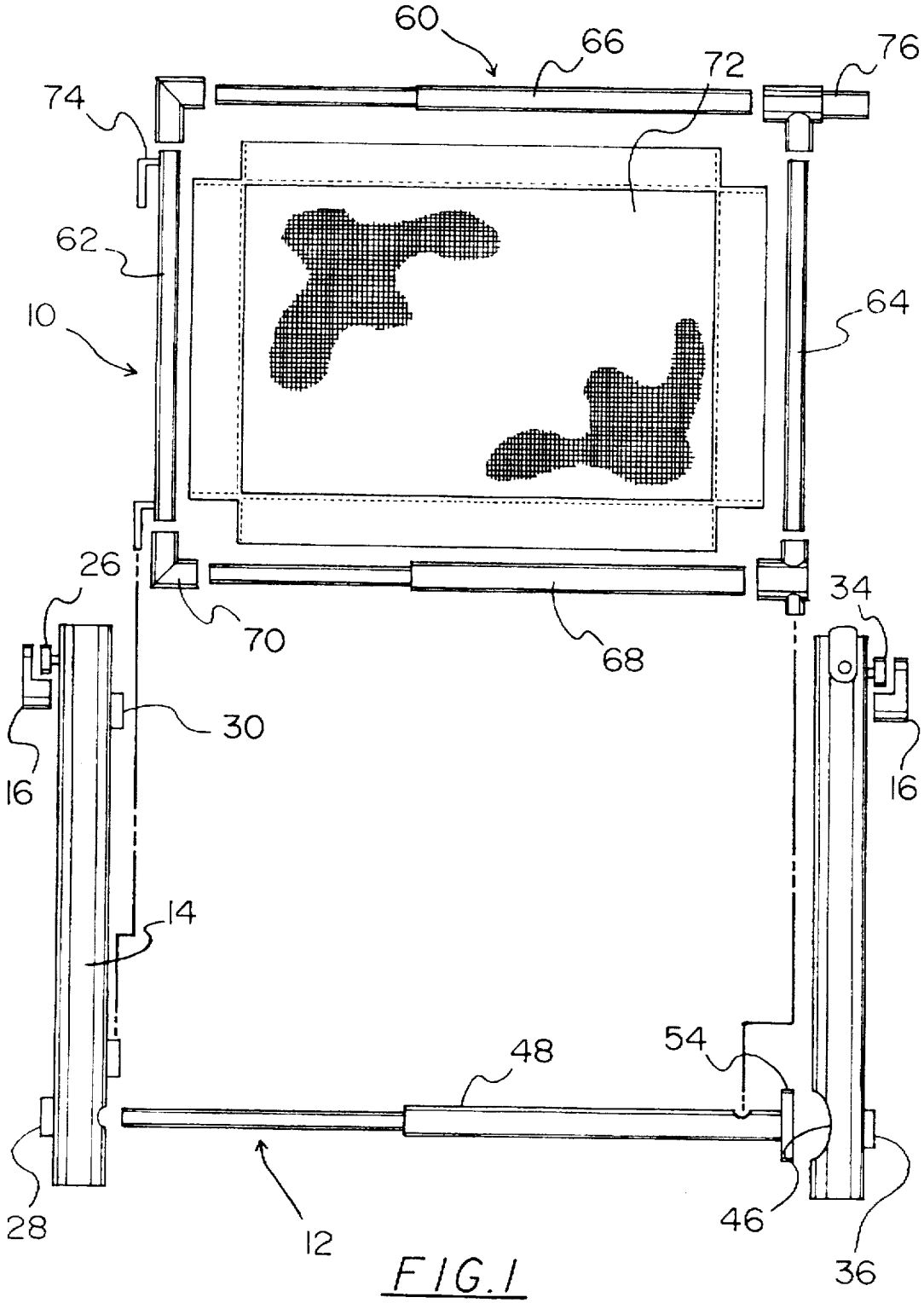
FIG. 1 is a front view of the preferred embodiment of the adjustable and removable safety gate constructed in accordance with the principles of the present invention.
Figure 2:
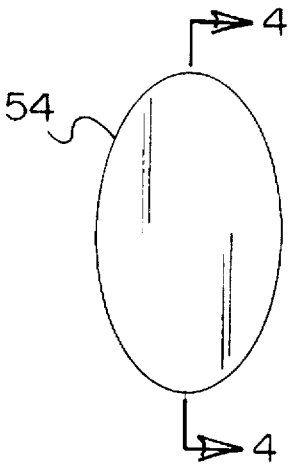
FIG. 2 is a front view of the mounting cap of the bottom tube of the wall mount frame of the present invention.
Figure 3:
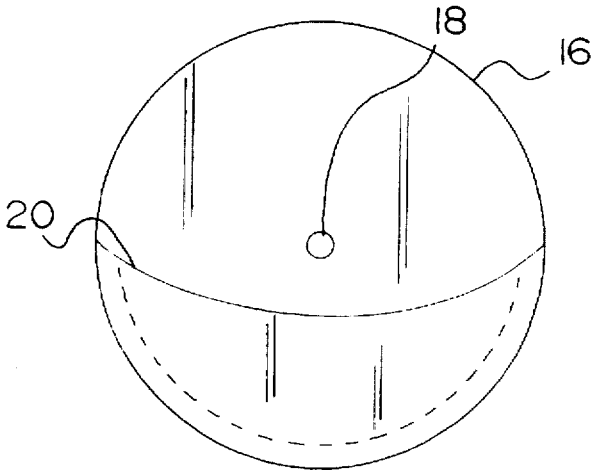
FIG. 3 is a front view of the door jamb mount of the wall mount frame of the present invention.
Figure 4:
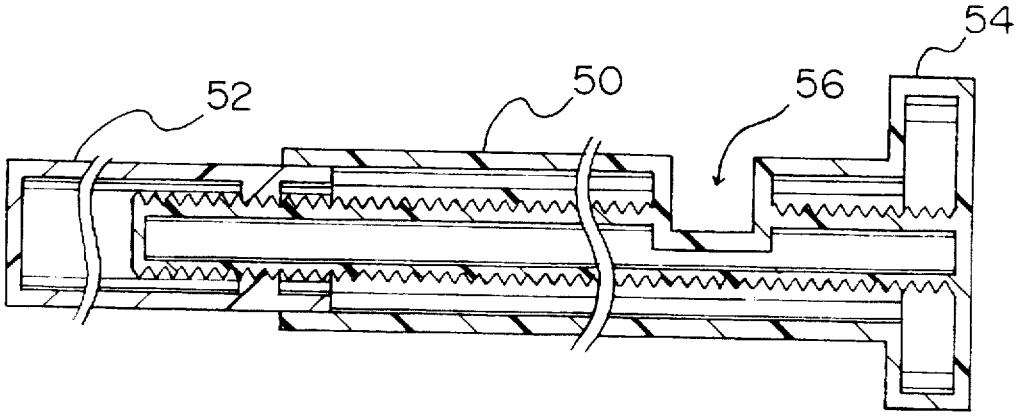
FIG. 4 is a cross-sectional view of the bottom tube of the wall mount frame of the present invention.
Figure 5:
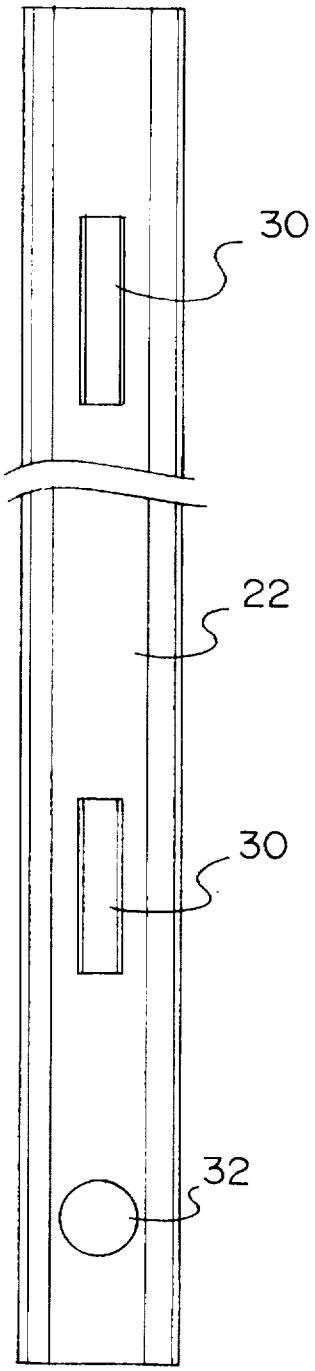
FIG. 5 is a side view of the interior surface of the left mount of the wall mount frame of the present invention.
Figure 6:
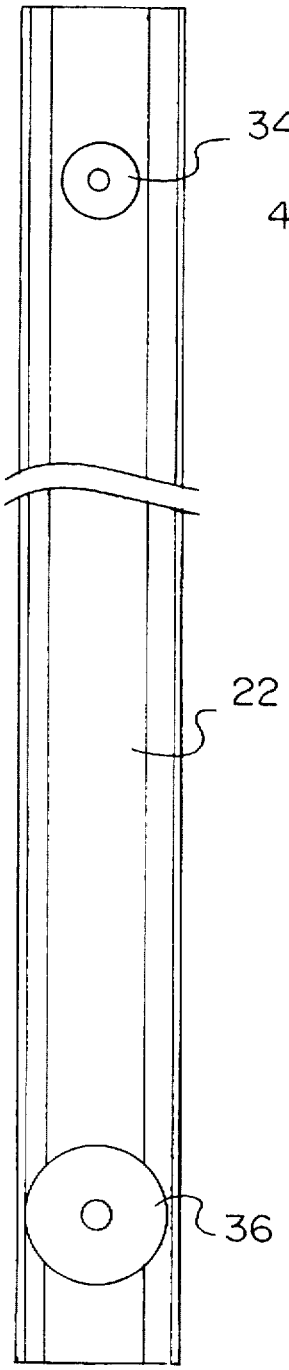
FIG. 6 is a side view of the exterior surface of the left mount of the wall mount frame of the present invention.
Figure 7:
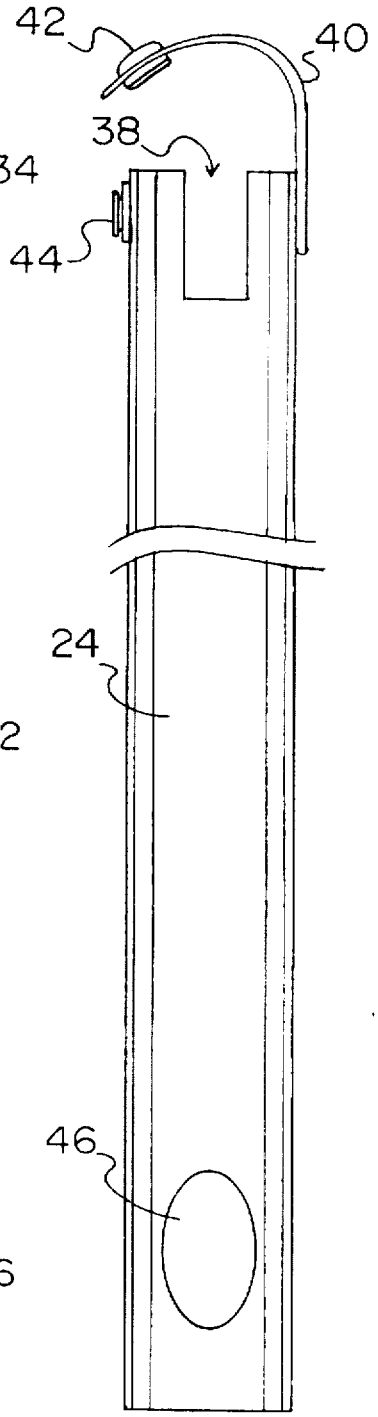
FIG. 7 is a side view of the interior surface of the right mount of the wall mount frame of the present invention.

With reference now to the drawings, and in particular, to FIGS. 1 through 7 thereof, the preferred embodiment of the new and improved adjustable and removable safety gate embodying the principles and concepts of the present invention and generally designated by the reference number 10 will be described.

Specifically, it will be noted in the various Figures that the device relates to a adjustable and removable safety gate for preventing children and pets from entering off-limits areas. In its broadest context, the device consists of a wall mount frame and a gate portion. Such components are individually configured and correlated with respect to each other so as to attain the desired objective.

The device 10 includes a wall mount frame 12 having a pair of door jamb mounts 14. The door jamb mounts 14 are secured to opposing door jambs of a door opening. Each of the door jamb mounts 14 include a circular disk 16 having a mounting aperture 18 therethrough. Note FIG. 3. A semi-circular receiving sleeve 20 is integral with an outer surface of the circular disk 16. The wall mount frame 12 includes a left mount 22 and a right mount 24. The left mount 22 comprises an elongated cylindrical member. Note FIG. exterior surface. The interior surface has a mounting knob 26 extending outwardly of an upper end thereof. The mounting knob 26 is removably received within one of the receiving sleeves 16 of the door jamb mount on a left side of the door jamb. The interior surface has a rubber stop 28 secured on a lower end thereof. The exterior surface has a pair of sleeves 30 disposed thereon. An aperture 32 extends through a lower end of the exterior surface. The right mount 24 comprises an elongated cylindrical member. Note FIGS. 6 and 7. The right mount 24 has an interior surface and an exterior surface. The interior surface of the right mount 24 has a mounting knob 34 extending outwardly of an upper end thereof. The mounting knob 34 is removably received within one of the receiving sleeves 16 of the door jamb mount on a right side of the door jamb. The interior surface of the right mount 24 has a rubber stop 36 secured on a lower end thereof. An upper end of the right jamb has a receiving recess 38 extending downwardly thereof. The upper end has a strap 40 secured thereto disposed on one side of the receiving recess. The strap 40 has a female coupler 42 on a free end thereof. A male coupler 44 is disposed on an opposing side of the receiving recess 42 from the strap. An oval-shaped recess 46 extends through a lower end of the exterior surface of the right jamb. The wall mount frame 12 includes a telescoping bottom tube 48. The bottom tube 48 includes a right portion 50 and a left portion 52 whereby the left portion 52 is adjustably received within the right portion 50. Note FIG. 4. A free end of the left portion 52 is removably received within the aperture 32 of the exterior surface of the left mount. A free end of the right portion 50 has an oval-shaped knob 54 disposed thereon. The oval-shaped knob 54 is removably received within the oval-shaped recess 46 of the right jamb. The right portion 50 has a recess 56 formed therein inwardly of the free end thereof.

Associated with the wall mount frame 12 is the gate portion 60. The gate portion 60 has a generally rectangular configuration. Note FIG. 1. The gate portion 60 has a left side member 62, a right side member 64, an upper telescoping member 66, a lower telescoping member 68 and four L-shaped corner brackets 70 together forming the gate portion. A canvas panel 72 extends within the gate portion 60 to form a closure. The left side member 62 has a pair of inverted L-shaped brackets 74 disposed on an interior surface thereof. The brackets 74 are slidably and pivotally received within the pair of sleeves 30 of the left mount of the wall mount frame. An upper right corner bracket has an extension 76 extending outwardly thereof. The extension 76 is removably received within the receiving recess 38 of the right mount of the wall mount frame. A lower right corner bracket has a lower extension 78 extending downwardly therefrom. The lower extension 78 is removably received within the recess 56 formed in the right portion of the bottom tube of the wall mount frame.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. An adjustable and removable safety gate for preventing children and pets from entering off-limits areas comprising, in combination:

a wall mount frame having a pair of door jamb mounts, the door jamb mounts secured to opposing door jambs of a door opening, each of the door jamb mounts comprising a circular disk having a mounting aperture therethrough, a semi-circular receiving sleeve integral with an outer surface of the circular disk, the wall mount frame including a left mount and a right mount, the left mount comprising an elongated cylindrical member, the left mount having an interior surface and an exterior surface, the interior surface having a mounting knob extending outwardly of an upper end thereof, the mounting knob being removably received within one of the receiving sleeves of the door jamb mount on a left side of the door jamb, the interior surface having a rubber stop secured on a lower end thereof, the exterior surface having a pair of sleeves disposed thereon, an aperture extends through a lower end of the exterior surface, the right mount comprising an elongated cylindrical member, the right mount having an interior surface and an exterior surface, the interior surface of the right mount having a mounting knob extending outwardly of an upper end thereof, the mounting knob being removably received within one of the receiving sleeves of the door jamb mount on a right side of the door jamb, the interior surface of the right mount having a rubber stop secured on a lower end thereof, an upper end of the right jamb having a receiving recess extending downwardly thereof, the upper end having a strap secured thereto disposed on one side of the receiving recess, the strap having a female coupler on a free end thereof, a male coupler disposed on an opposing side of the receiving recess from the strap, an oval-shaped recess extends through a lower end of the exterior surface of the right jamb, the wall mount frame including a telescoping bottom tube, the bottom tube including a right portion and a left portion whereby the left portion is adjustably received within the right portion, a free end of the left portion removably received within the aperture of the exterior surface of the left mount, a free end of the right portion having an oval-shaped knob disposed thereon, the oval-shaped knob removably receiving within the oval-shaped recess of the right jamb, the right portion having a recess formed therein inwardly of the free end thereof; and a gate portion having a generally rectangular configuration, the gate portion having a left side member, a right side member, an upper telescoping member, a lower telescoping member and four L-shaped corner brackets together forming the gate portion, the left side member having a pair of inverted L-shaped brackets disposed on an interior surface thereof, the brackets slidably and pivotally received within the pair of sleeves of the left mount of the wall mount frame, an upper right corner bracket having an extension extending outwardly thereof, the extension removably received within the receiving recess of the right mount of the wall mount frame, a lower right corner bracket having a lower extension extending downwardly therefrom, the lower extension removably received within the recess formed in the right portion of the bottom tube of the wall mount frame.

2. An adjustable and removable safety gate for preventing children and pets from entering off-limits areas comprising, in combination:

a wall mount frame having a pair of door lamb mounts secured to opposing door iambs of a door opening, the wall mount frame including a telescoping bottom tube, the bottom tube including a right portion and a left portion whereby the left portion is adjustably received within the right portion, the bottom tube extending between the pair of door jamb mounts; and a gate portion slidably and pivotally coupled with one of the door iamb mounts of the wall mount frame;

wherein each of the door jamb mounts comprising a circular disk having a mounting aperture therethrough, a semi-circular receiving sleeve integral with an outer surface of the circular disk.

3. The safety gate as set forth in claim 2, wherein the wall mount frame including a left mount and a right mount, the left mount comprising an elongated cylindrical member, the left mount having an interior surface and an exterior surface, the interior surface having a mounting knob extending outwardly of an upper end thereof, the mounting knob being removably received within one of the receiving sleeves of the door jamb mount on a left side of the door jamb, the interior surface having a rubber stop secured on a lower end thereof, the exterior surface having a pair of sleeves disposed thereon, an aperture extends through a lower end of the exterior surface.

4. The safety gate as set forth in claim 3 wherein the right mount comprising an elongated cylindrical member, the right mount having an interior surface and an exterior surface, the interior surface of the right mount having a mounting knob extending outwardly of an upper end thereof, the mounting knob being removably received within one of the receiving sleeves of the door jamb mount on a right side of the door jamb, the interior surface of the right mount having a rubber stop secured on a lower end thereof.

5. The safety gate as set forth in claim 4 wherein an upper end of the right jamb having a receiving recess extending downwardly thereof, the upper end having a strap secured thereto disposed on one side of the receiving recess, the strap having a female coupler on a free end thereof, a male coupler disposed on an opposing side of the receiving recess from the strap, an oval-shaped recess extends through a lower end of the exterior surface of the right jamb.

6. The safety gate as set forth in claim 5 wherein a free end of the left portion removably received within the aperture of the exterior surface of the left mount, a free end of the right portion having an oval-shaped knob disposed thereon, the oval-shaped knob removably received within the oval-shaped recess of the right jamb, the right portion having a recess formed therein inwardly of the free end thereof.

7. The safety gate as set forth in claim 6 wherein the gate portion having a left side member, a right side member, an upper telescoping member, a lower telescoping member and four L-shaped corner brackets together forming the gate portion.

8. The safety gate as set forth in claim 7 wherein the left side member having a pair of inverted L-shaped brackets disposed on an interior surface thereof, the brackets slidably and pivotally received within the pair of sleeves of the left mount of the wall mount frame.

9. The safety gate as set forth in claim 8 wherein an upper right corner bracket of the gate portion having an extension extending outwardly thereof, the extension removably received within the receiving recess of the right mount of the wall mount frame.

10. The safety gate as set forth in claim 9 wherein a lower right corner bracket of the gate portion having a lower extension extending downwardly therefrom, the lower extension removably received within the recess formed in the right portion of the bottom tube of the wall mount frame.

* * * * *

UNITED STATES PATENT AND TRADEMARK OFFICE

CERTIFICATE OF CORRECTION

PATENT NO : 5,797,218

DATED : August 25, 1998

INVENTOR(S) : Holland, Matthew W. and Kathleen M.

It is certified that error appears in the above-identified patent and that said Letters Patent is hereby corrected as shown below:

Title page, line 5, [76] Inventor: Add Kathleen M. Holland